US007322504B2

(12) United States Patent
Chen

(10) Patent No.: US 7,322,504 B2
(45) Date of Patent: Jan. 29, 2008

(54) STAPLER WITH AN ARTICULATED LEVER ASSEMBLY

(75) Inventor: Jau-Shyong Chen, Chang Hua (TW)

(73) Assignee: SDI Corporation, Chang Hua (TW)

( * ) Notice: Subject to any disclaimer, the term of this patent is extended or adjusted under 35 U.S.C. 154(b) by 43 days.

(21) Appl. No.: 11/362,861

(22) Filed: Feb. 28, 2006

(65) Prior Publication Data

US 2007/0199971 A1 Aug. 30, 2007

(51) Int. Cl.
*B25C 5/00* (2006.01)
*B27F 7/00* (2006.01)

(52) U.S. Cl. ..... 227/129; 227/127; 227/128; 227/134

(58) Field of Classification Search ..... 227/129, 227/127, 128, 134
See application file for complete search history.

(56) References Cited

U.S. PATENT DOCUMENTS 4,184,620 A * 1/1980 Ewig ..... 227/8
4,288,019 A * 9/1981 Dahle ..... 227/144
4,984,729 A * 1/1991 Balma ..... 227/128
5,704,533 A * 1/1998 Chang ..... 227/124
6,726,081 B1 * 4/2004 Lin ..... 227/123
7,014,090 B1 * 3/2006 Chang ..... 227/132
7,124,922 B2 * 10/2006 Marks ..... 227/8
2004/0232192 A1 * 11/2004 Marks ..... 227/120

* cited by examiner

*Primary Examiner*—Brian D. Nash
(74) *Attorney, Agent, or Firm*—Rosenberg, Klein & Lee

(57) ABSTRACT

A stapler has a base, a magazine, a handle assembly and an articulated lever assembly. The base has a stationary bracket and a recoiling tab mounted to the stationary bracket. The magazine is mounted pivotally to the base and has a frame mounted pivotally on the base and a slot defined in the frame. The handle assembly is mounted pivotally to the base and has a handle and a magazine cap mounted pivotally on the base. The articulated lever assembly is mounted pivotally to the handle assembly and the base and has a lever and a link. The lever is mounted pivotally to the base. The link is mounted pivotally between the lever and the handle. The articulated lever assembly allows a user, especially a female or a child to press the stapler without strenuous effort when stapling paper sheets.

3 Claims, 6 Drawing Sheets

STAPLER WITH AN ARTICULATED LEVER ASSEMBLY

BACKGROUND OF THE INVENTION

1. Field of the Invention

The present invention relates to a stapler, and more specifically to a stapler that has an articulated lever assembly and allows people to easily staple documents without strenuous effort.

2. Description of Related Art

Staplers are common stationery in offices and are used to fix separate documents or sheets of paper together. During the course of a single day an office worker could routinely staple documents with staplers hundreds of times everyday. A large percentage of these workers are female who may not have the strength required for continuous heavy stapling. When stapling documents, the office worker must forcefully push the lever of the stapler in order for the staple to penetrate the sheets of paper or document. After hundreds of times of stapling day after day, the workers can experience aches and pains on the palms of the hand or in the fingers. Over time this repetitive motion can cause the workers to develop a critical occupational syndrome in their hands, which can prevent them from working.

To overcome this occupational problem, the present invention provides a stapler with an articulated lever assembly to mitigate or obviate the aforementioned problems.

SUMMARY OF THE INVENTION

The main objective of the invention is to provide a stapler that has an articulated lever assembly and allows people to easily staple documents without strenuous effort.

A stapler in accordance with the present invention comprises of a base, a magazine, a handle assembly and an articulated lever assembly. The base has a stationary bracket and a recoiling tab mounted to the stationary bracket. The magazine is mounted pivotally to the base and has a frame mounted pivotally on the base and a slot defined in the frame. The handle assembly is mounted pivotally to the base and has a handle and a magazine cap mounted pivotally on the base. The articulated lever assembly is mounted pivotally to the handle assembly and the base and has a lever and a link. The lever is mounted pivotally to the base. The link is mounted pivotally between the lever and the handle.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
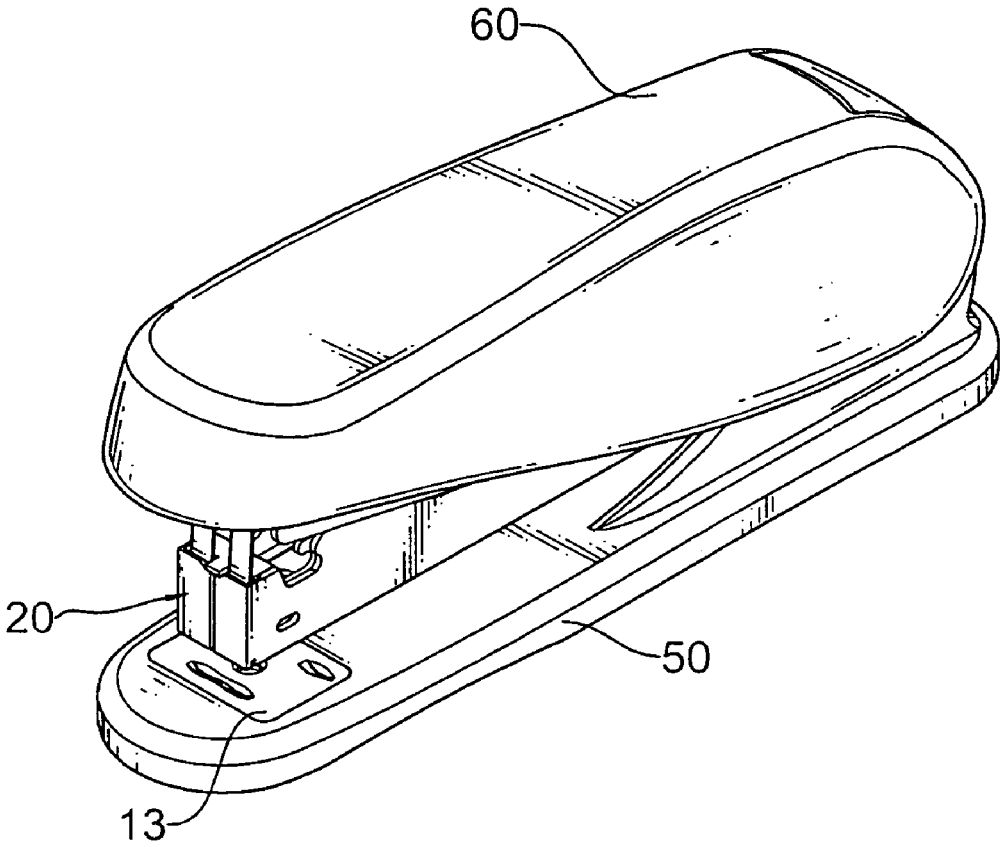
FIG. 1 is a perspective view of a stapler with an articulated lever assembly in accordance with the present invention.
Figure 2:
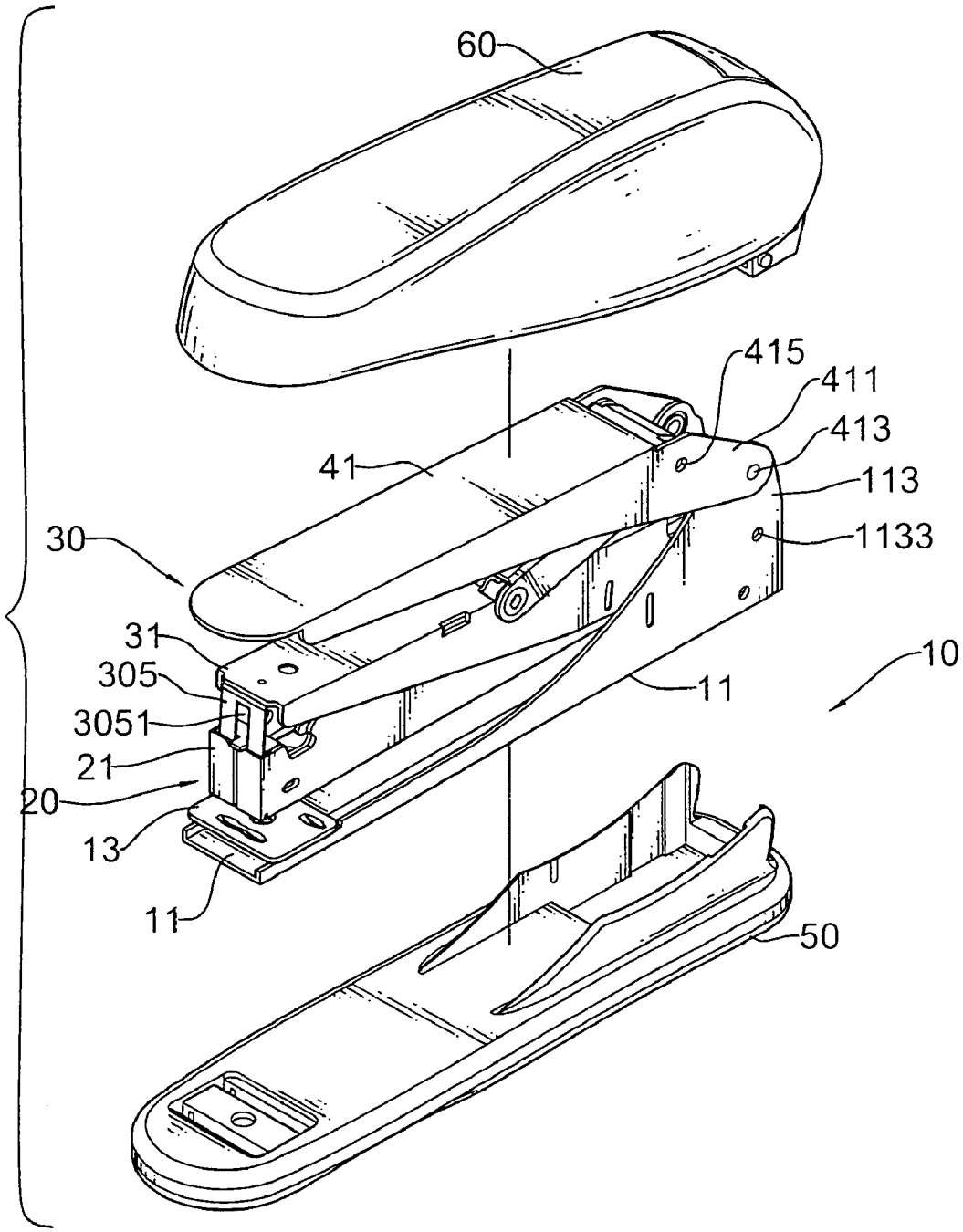
FIG. 2 is a partial exploded perspective view of the stapler in FIG. 1.
Figure 3:
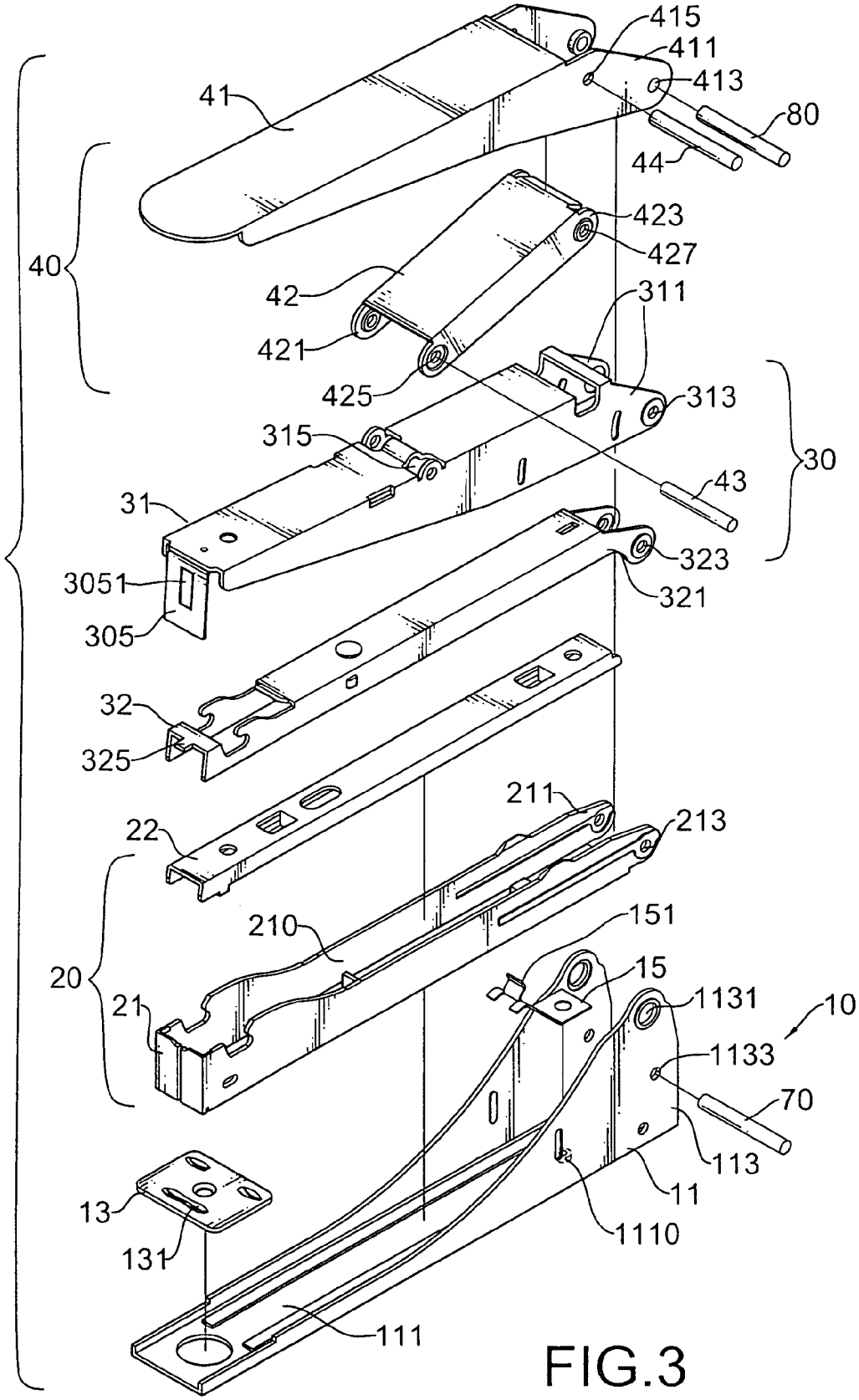
FIG. 3 is an exploded perspective view of the stapler in FIG. 2 without the upper and lower covers.

With reference to FIGS. 1, 2 and 3, a stapler in accordance with the present invention comprises a base (10), a magazine (20), a handle assembly (30), a lower pin (70), an articulated lever assembly (40), an upper pin (80), a lower cover (50) and an upper cover (60).

Figure 4:
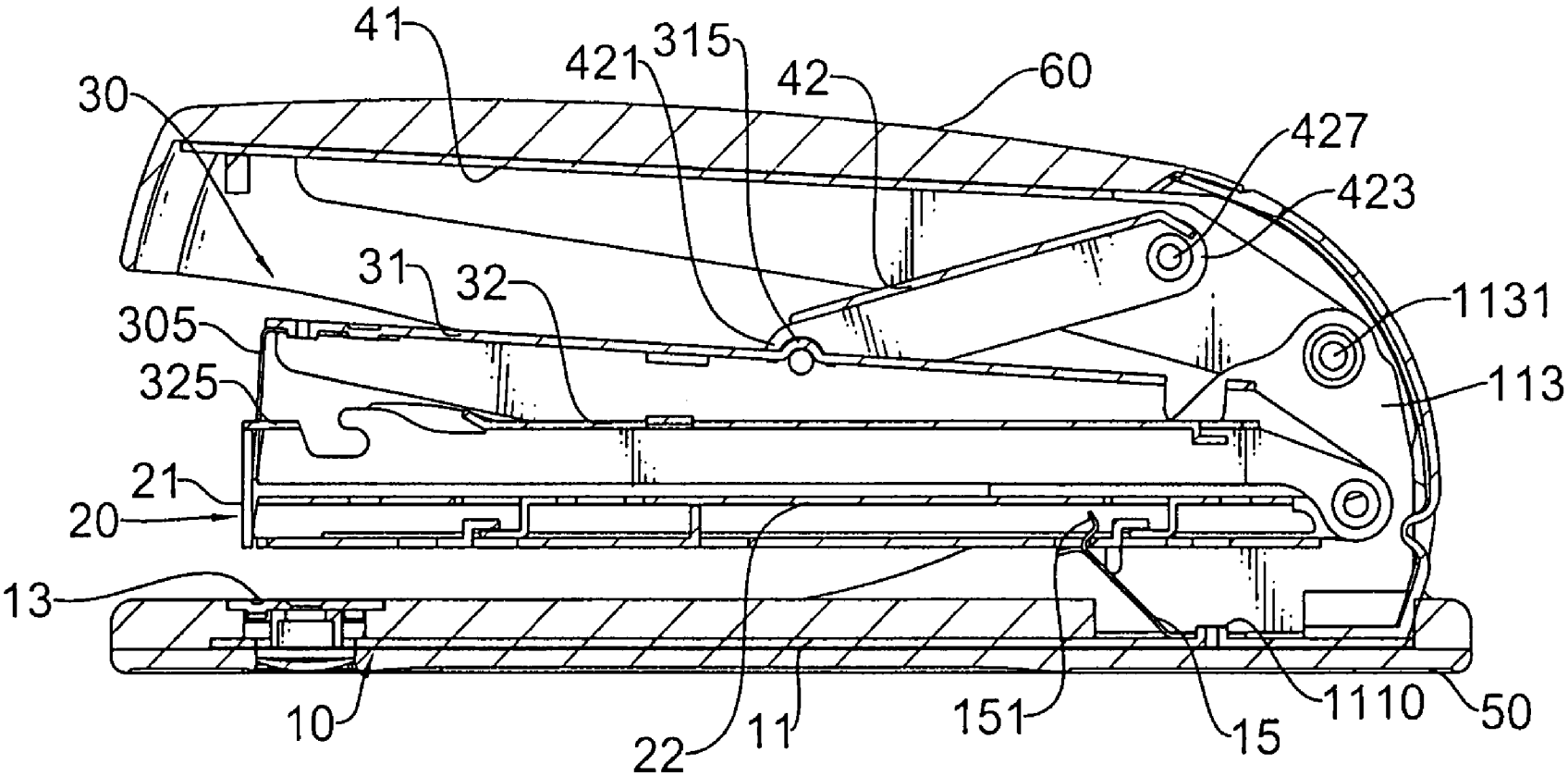
FIG. 4 is a cross sectional side view of the stapler in FIG. 1.

With reference FIGS. 3 and 4, the base (10) has a stationary bracket (11), an anvil (13) and a recoiling tab (15).

The stationary bracket (11) has a bottom plate (111) and two wings (113). The bottom plate (111) has a front end, a rear end, a top, two opposite side edges and a mounting protrusion (1110). The mounting protrusion (1110) extends up from the top of the bottom plate (111). The wings (113) respectively extend upward from the side edges of the bottom plate (111) and each wing (113) has an upper pivot hole (1131) and a lower pivot hole (1133). The upper pivot hole (1131) is defined through the wing (113) close to the rear end of the bottom plate (111). The lower pivot hole (1133) is defined through the wing (113) under the upper pivot hole (1131) close to the rear end of the bottom plate (111).

The anvil (13) is mounted on the top of the bottom plate (111) of the stationary bracket (11) and has a top concave (131). The anvil (13) presses against and bends two ends of a staple when the stapler operates to push the staple down toward the top concave (131) of the anvil (13).

The recoiling tab (15) is flexible, is mounted on and extends up from the top of the bottom plate (111) of the stationary bracket (11). The recoiling tab (15) has a bottom end, a top end (151) and a mounting hole defined through the bottom end and through which the mounting protrusion (1110) is mounted.

The magazine (20) is mounted pivotally to the base (10), receives staples, is held by top end (151) of the recoiling tab (15) preventing the magazine (20) from pressing against the anvil (13) and has a frame (21) and a rail (22).

Figure 5:
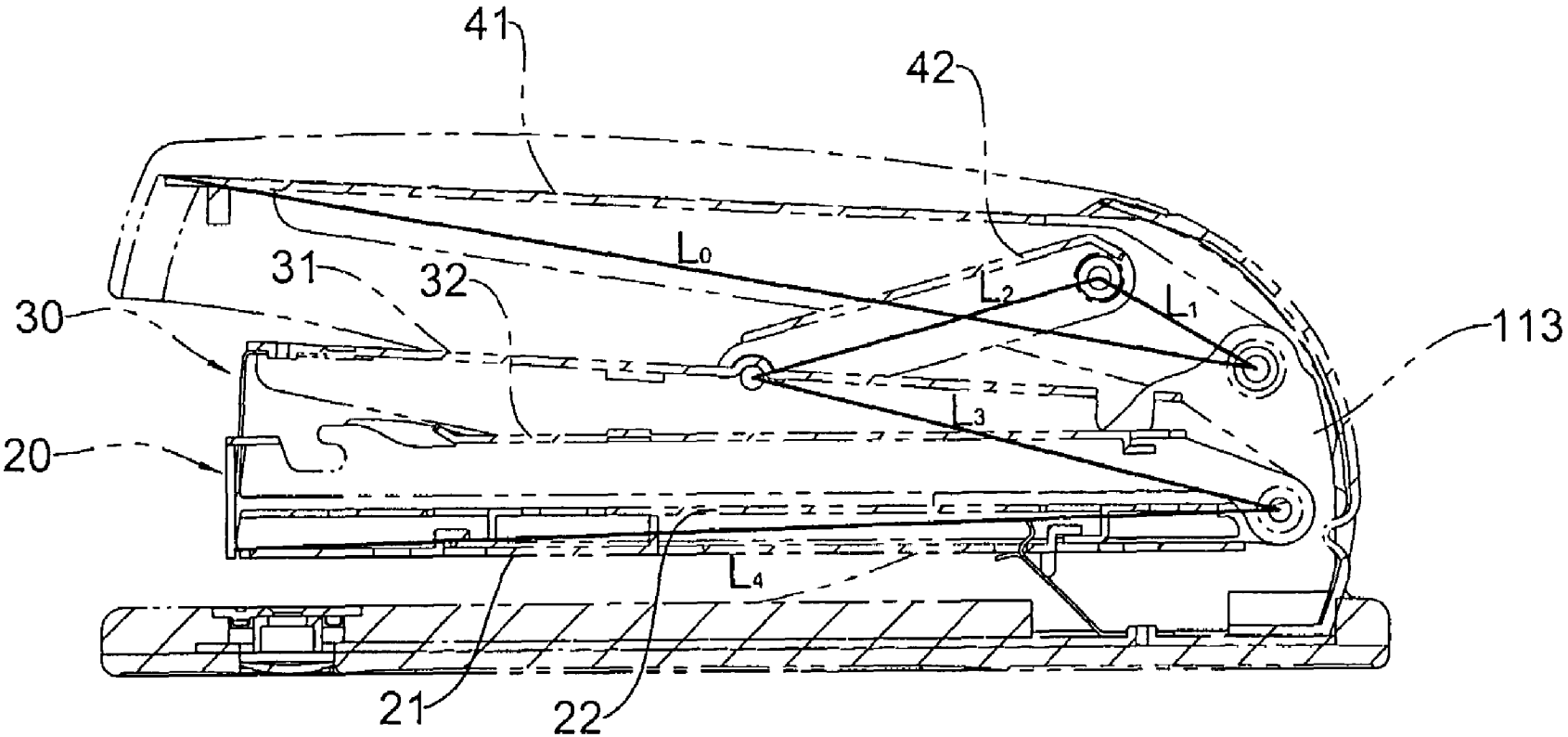
FIG. 5 is a side view of the stapler in FIG. 4 with thick lines representing the lengths of the lever and links of the articulated lever assembly.

With further reference to FIG. 5, the frame (21) is mounted pivotally to the base (10) and has a top, a front end, a rear end, a slot (210), two pivot tabs (211), two pivot holes (213) and a length ($L_4$). The slot (210) is defined longitudinally in the top of the frame (21) for receiving the staples. The rear end of the frame (21) is mounted pivotally between the wings (113) on the stationary bracket (11) of the base (10). The pivot tabs (211) extend from the rear end of the frame (21) at an interval and are pivotally mounted respectively to the wings (113) on the stationary bracket (11) of the base (10). The pivot holes (213) are defined respectively through the pivot tabs (211) at the rear end of the frame (21) and are aligned with the lower pivot holes (1133) in the wings (113). The length ($L_4$) of the frame (21) is 145 units.

The rail (22) is mounted in the slot (210) in the frame (21), has a U-shaped cross section corresponding to a shape of a staple and can hold the staples without swaying inadvertently when the staples slide on the rail (22).

The handle assembly (30) is mounted pivotally to the base (10) and has a handle (31) and a magazine cap (32).

The handle (31) is mounted pivotally to the base (10) and has a front end, a rear end, two pivot tabs (311), two pivot holes (313), a pivot element (315) and an actuating tab (305). The rear end of the handle (31) is mounted pivotally between the wings (113) on the stationary bracket (11) of the base (10). The pivot tabs (311) extends from the rear end of the handle (31) at an interval and are pivotally mounted respectively to the wings (113) on the stationary bracket (11) of the base (10). The pivot holes (313) are defined respectively through the pivot tabs (311) at the rear end of the handle (31) and are aligned with the lower pivot holes (1133) in the wings (113). The pivot element (315) is formed on the handle (31) between the front and rear ends and has a pivot hole defined through the pivot element (315). The actuating tab (305) is mounted on and extends down from the front end of the handle (31) and has a mounting slot (3051) defined through the actuating tab (305).

The magazine cap (32) is mounted pivotally to the base (10), selectively covers the slot (210) in the frame (21) and has a front end, a rear end, two pivot tabs (321), two pivot holes (323) and a connecting tab (325). The rear end of the magazine cap (32) is mounted pivotally between the wings (113) on the stationary bracket (11) of the base (10). The pivot tabs (321) extend from the rear end of the magazine cap (32) and are pivotally mounted respectively to the wings (113). The pivot holes (323) are defined respectively through the pivot tabs (321) on the magazine cap (32) and are aligned with the lower pivot holes (1133) in the wings (113). The connecting tab (325) protrudes from the front end of the magazine cap (32) and extends through the mounting slot (3051) in the actuating tab (305) on the handle (31).

The lower pin (70) extends through the lower pivot holes (1133) in the wings (113) on the stationary bracket (11) of the base (10), the pivot holes (213, 313,323) in the pivot tabs (211,311,321) on the frame (21), the handle (31) and the magazine cap (32).

The articulated lever assembly (40) is mounted pivotally to the handle assembly (30) and the base (10) and has a lever (41), a link (42), a handle pin (43) and a lever pin (44).

With further reference to FIG. 5, the lever (41) is mounted pivotally to the base (10) and has a front end, a rear end, two pivot tabs (411), two rear pivot holes (413), two front pivot holes (415) and a length ($L_0$). The rear end of the lever (41) is mounted pivotally between the wings (113) on the stationary bracket (11) of the base (10) and is located above the rear ends of the frame (21), handle (31) and magazine cap (32). The pivot tabs (411) extend from the rear end of the lever (41), are pivotally mounted respectively to the wings (113). Each pivot tab (411) has a proximal end formed on the rear end of the lever (41) and a distal end mounted pivotally to a corresponding wing (113) at a distance above the pivot tabs (211, 311, 321) on the rear ends of the frame (21), the handle (31) and the magazine cap (32). The rear pivot holes (413) are defined respectively through the pivot tabs (411) close to the distal ends and are aligned with the upper pivot holes (1131) in the wings (113). The front pivot holes (415) are defined respectively through the pivot tabs (411) in front of the rear pivot holes (413). The length ($L_0$) of the lever (41) is 152 units.

The link (42) is mounted pivotally between the lever (41) and the handle (31) and has a front end, a rear end, two front pivot tabs (421), two rear pivot tabs (423), two front pivot holes (425), two rear pivot holes (427) and a length ($L_2$). The front end of the link (42) is mounted pivotally to the pivot element (315) and the rear end is mounted pivotally between the pivot tabs (411) on the lever (41). The front pivot tabs (421) extend from the front end of the link (42) and are mounted to the pivot element (315) on the handle (31). The rear pivot tabs (423) extend from the rear end of the link (42) and are mounted respectively to the pivot tabs (411) on the lever (41) close to the proximal ends. The front pivot holes (425) are defined respectively through the front pivot tabs (421) and are aligned with the pivot hole in the pivot element (315) on the handle (31). The rear pivot holes (427) are defined respectively through the rear pivot tabs (423) on the link (42) and are aligned with the front pivot holes (415) in the lever (41).

A distance ($L_1$) between the rear pivot holes (427) in the link (42) and the upper pivot holes (1131) in the wings (113) on the stationary bracket (11) is 25 units. A distance ($L_3$) between the front pivot holes (425) in the link (42) and the lower pivot holes (1133) in the wings (113) is 75 units.

The handle pin (43) extends through the front pivot holes (425) in the link (42) and the pivot hole in the handle (41). The lever pin (44) extends through the rear pivot holes (427) in the link (42) and the front pivot holes (415) in the lever (41). The upper pin (80) extends through the rear pivot holes (413) in the pivot tabs (411) on the lever (41) and the upper pivot holes (1131) in the wings (113) of the base (10).

The lower cover (50) and the upper cover (60) are respectively mounted to and cover the base (10) and the lever (41) of the articulated lever assembly (40).

Figure 6:
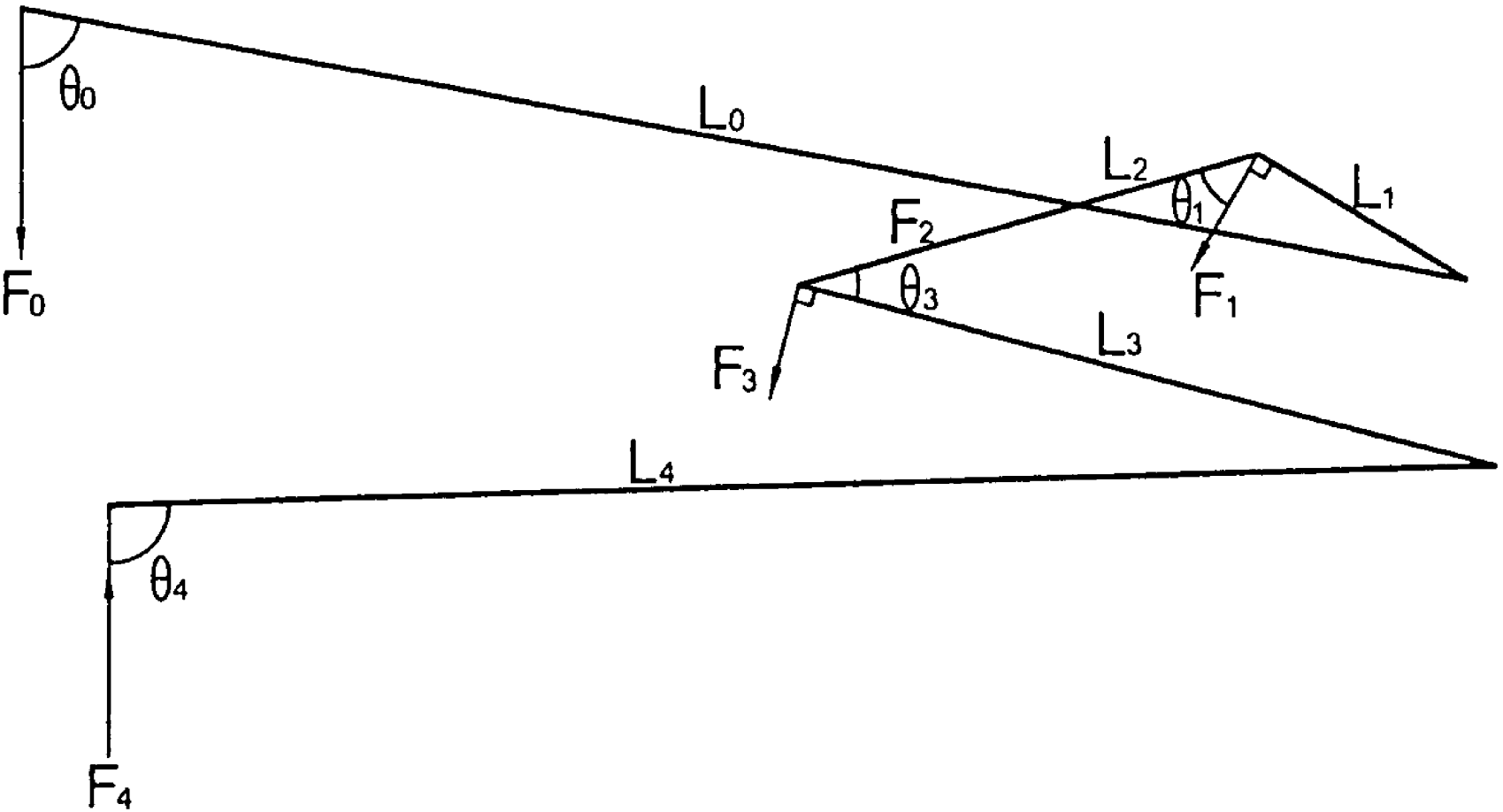
FIG. 6 is a diagram of the thick lines corresponding to the stapler in FIG. 4 with arrows representing the forces applied to the stapler.

With reference to FIGS. 5 and 6, pressing the lever (41) covered with the upper cover (60) drives the link (40) to pivot the handle assembly (30) down. The handle assembly (30) then drives the magazine (20) to pivot down and press against the anvil (13). Further pressing the lever after the contact of the magazine (20) with the anvil (13) makes the actuating tab (305) on the handle (31) actuate a staple in the magazine (20) through a paper sheet lying on the anvil (13). The stapler with the articulated lever assembly (40) is more effort-saving than a conventional staple without the articulated lever assembly.

To prove that the stapler with the articulated lever assembly (40) saves effort over the conventional stapler, the following equations are presented to calculate the moment of the stapler when an external force ($F_0$) is applied to the front end of the lever (41). Internal forces ($F_1$, $F_2$, $F_3$) derive from the external force ($F_0$) and a counterforce ($F_4$) is against the external force ($F_0$). Furthermore, angles ($\theta_0$, $\theta_1$, $\theta_3$, $\theta_4$) are defined between corresponding lengths ($L_0$, $L_4$), distances ($L_1$, $L_3$) and forces ($F_0$, $F_1$, $F_2$, $F_3$, $F_4$) for the calculation.

$$L_0=152;\ L_1=25;\ \theta_0=86.243°;\ \theta_1=47.864°;$$

$$F_0\times\sin(\theta_0)\times L_0=F_1\times L_1;\ F_1=F_2\times\cos(\theta_1);$$

$$F_0\times\sin(86.243°)\times L_0=F_2\times\cos(47.864°)\times L_1;$$

$$151.67\ F_0=16.77\ F_2;\ F_2=9.044\ F_0;$$

$$L_3=75;\ L_4=145;\ \theta_3=28.964°;\theta_4=84.441°;$$

$$F_4\times\sin(\theta_4)\times L_4=F_3\times L_3;\ F_3=F_2\times\sin(\theta_3);$$

$$F_4\times\sin(84.441°)\times L_4=F_2\times\sin(28.964°)\times L;$$

$$144.32\ F_4=35.848\ F_2;\ F_2=4.026\ F_4;$$

$$4.026\ F_4=9.044\ F_0;\ F_4=2.246\ F_0;$$

$$\text{Effort-saving rate}=(2.246-1)/(2.246)=55.47\%$$

The articulated lever assembly (40) allows a user, especially a female or a child to press the stapler without strenuous effort when stapling paper sheets. Therefore, injury to the user's palms or fingers resulting from operating the stapler is avoided.

What is claimed is:

1. A stapler comprising:

a base having a stationary bracket and a recoiling tab mounted to the stationary bracket;

a magazine mounted pivotally to the base and being held by the recoiling tab, the magazine having a frame mounted pivotally on the base, the frame having a front end, a rear end mounted pivotally to the stationary bracket, and a slot formed in the frame and adapted for receiving staples and a rail mounted in the slot;

a handle assembly mounted pivotally to the base and including a driver means for driving a staple into a work piece, a handle mounted pivotally on the base, the handle having a front end, a rear end mounted pivotally on the stationary bracket, the handle assembly including a magazine cap mounted pivotally to the base, selectively covering the slot in the frame, the magazine cap having a front end and a rear end mounted pivotally on the stationary bracket; and an articulated lever assembly mounted pivotally to the handle assembly and the base and including a lever mounted pivotally to the base, the lever having a front end and a rear end mounted pivotally on the stationary bracket and located above the rear end of the frame, the rear end of the handle and the rear end of the magazine cap, the articulated lever assembly including a link mounted pivotally between the lever and the handle, the link having a front end mounted pivotally to the handle and a rear end mounted pivotally to the lever.

2. The stapler as claimed in claim 1, wherein:

the stationary bracket further has two wings extending from the stationary bracket and between which the rear end of the frame, the rear end of the handle and the rear end of the magazine cap are mounted pivotally;

the handle further has a pivot element formed on the handle between the front and rear ends of the handle;

the lever further has two pivot tabs extending from the rear end of the lever and pivotally mounted respectively to the wings, each pivot tab has a proximal end formed on the rear end of the lever and a distal end mounted pivotally to a corresponding wing;

the front end of the link is mounted pivotally to the pivot element on the handle; and the rear end of the link is mounted pivotally between the pivot tabs on the lever.

3. The stapler as claimed in claim 2 further having a lower cover and an upper cover respectively mounted to and covering the base and the lever of the articulated lever assembly.

* * * * *